US005267671A

United States Patent [19]

Baginski et al.

[11] Patent Number: 5,267,671

[45] Date of Patent: Dec. 7, 1993

[54] APPARATUS FOR DISPENSING RINSE WATER ADDITIVE IN AN AUTOMATIC WASHING MACHINE

[75] Inventors: Richard M. Baginski, West Chester; Jerome P. Cappel, Cincinnati; Gary E. McKibben, Middletown, all of Ohio

[73] Assignee: The Procter & Gamble Company, Cincinnati, Ohio

[21] Appl. No.: 851,581

[22] Filed: Mar. 16, 1992

[51] Int. Cl.[5] ..... B67D 5/38; B67D 5/64

[52] U.S. Cl. ..... 222/154; 222/158; 222/463; 222/500; 68/17 R; 73/427

[58] Field of Search ..... 222/154, 158, 463, 500, 222/543; 68/17 A, 17 R; 206/0.5; 73/426, 427, 429

[56] References Cited

U.S. PATENT DOCUMENTS

| | | | |
|---|---|---|---|
| T. 993,001 | 4/1980 | McCarthy | 68/17 R |
| 152,980 | 7/1874 | Donkin | 222/543 |
| 2,956,709 | 10/1960 | Nison et al. | 222/52 |
| 2,970,463 | 2/1961 | Johnston | 68/17 |
| 3,108,722 | 10/1963 | Torongo, Jr. et al. | 222/463 |
| 3,316,741 | 5/1967 | Harlow et al. | 68/207 |
| 3,620,054 | 11/1971 | Drews et al. | 68/17 A |
| 3,699,785 | 10/1972 | Waugh | 68/17 A |
| 3,888,391 | 6/1975 | Merz | 222/463 X |
| 4,033,643 | 7/1991 | Schumacher | 222/52 |
| 4,656,844 | 4/1987 | Mulder et al. | 68/17 A |
| 5,040,311 | 8/1991 | Roy | 34/60 |

FOREIGN PATENT DOCUMENTS

| | | | |
|---|---|---|---|
| 602945 | 4/1926 | France | 73/427 |
| WO89/07678 | 8/1989 | World Int. Prop. O. . | |

*Primary Examiner*—Kevin P. Shaver

*Attorney, Agent, or Firm*—Dean L. Garner; E. Kelly Linman

[57] ABSTRACT

An improved apparatus for accurately measuring and dispensing a rinse water additive in an automatic washing machine. In a particularly preferred embodiment, an apparatus is provided for accurately measuring a relatively small volume of fluid product by forming an annular column within the dispenser. The annular column extends at least to approximately the desired fill level for the additive so that the relatively small amount of fluid product causes a substantial change in the fluid's vertical position within the dispenser. This is preferably accomplished by providing a dispenser having an internal pushup configuration in its base, the pushup configuration extending at least to approximately the desired fill level within the dispenser. An improved sealing structure is also provided for the valve used to close the filling and dispensing aperture in the dispenser body during the wash cycle. A flexible securement member is used to secure a recessed valve to the dispenser to minimize the chances of premature opening during the wash cycle. Each of these improvements helps to insure that the correct amount of additive will be added to the dispenser and that substantially all of additive initially added to the dispenser will be present when the valve is opened by the centrifugal force of the spin cycle so that all of the material can be effectively utilized during the rinse cycle.

13 Claims, 2 Drawing Sheets

APPARATUS FOR DISPENSING RINSE WATER ADDITIVE IN AN AUTOMATIC WASHING MACHINE

TECHNICAL FIELD

The present relation relates to an improved method and apparatus for dispensing a rinse water additive in an automatic washing machine.

The present invention further relates to such a method and apparatus which is especially suited to highly concentrated rinse water additives which are added in relatively small volume, thereby making accurate measurement and avoidance of leakage during the wash cycle critical to obtaining the desired benefits to be provided by the additive during the rinse cycle.

The present invention has further relation to such a method and apparatus wherein the center of gravity of the apparatus and the rinse water additive fluid contained therein is maintained in such position that rinse water is readily able to enter and exit the dispenser during the rinse cycle after the dispensing valve has been opened, thereby ensuring that all of the rinse water additive initially provided in the dispenser is fully utilized during the rinse cycle.

BACKGROUND OF THE INVENTION

Dosing dispensers for the addition of laundering and softening materials during the washing and rinsing cycles in an automatic washing machine are well known in the art.

Dispensers for adding materials during the rinse cycle in an automatic washer are generally more complex than those employed for adding materials during the wash cycle due to the fact that the rinse additive dispenser is normally inserted when the wash cycle begins and must survive the entire wash cycle without dispensing the material contained inside, yet reliably open during the spin cycle at the conclusion of the wash cycle to deliver the rinse water additive at a point in time which will be effective.

One prior art example of such a rinse water additive dispenser is disclosed in commonly assigned U.S. Pat. No. 3,888,391 issued to Merz on Jun. 10, 1975 and hereby incorporated herein by reference.

Another example of such a prior art rinse water additive dispenser is disclosed in U.S. Defensive Publication No. T993,001 to McCarthy, which was published on Apr. 1, 1980, and which is hereby incorporated herein by reference.

Dispensers of the aforementioned type employ a valve means which is automatically opened by centrifugal forces acting upon a counterweight during the spin cycle at the conclusion of the wash operation. After the spin cycle, dispensers of the aforementioned type fall from the wall of the washing machine drum and rinse water floods the dispenser, mixing with and dispensing the additive into the rinse water.

While dispensers of the aforementioned type have functioned adequately for their intended purpose with prior art rinse water additives, recent trends in the development of more effective rinse water additives have been in the direction of more highly concentrated products which deliver comparable performance benefits to the less concentrated products which they are tending to replace. For example, one fluid ounce of a highly concentrated fabric softener, such as Ultra Downy® now being marketed by The Procter & Gamble Company of Cincinnati, Ohio, can deliver benefits comparable to three fluid ounces of a less concentrated fluid softener product of the type which has been on the market for several years.

However, to obtain maximum performance benefits from the newer more highly concentrated products, accuracy of measurement has become much more critical. In addition, it has become much more critical that substantially all of the additive material initially placed in the dispenser be retained within the dispenser during the wash cycle, since any lost additive material will not be available to accomplish its intended objective during the rinse cycle.

Prior art rinse additive dispensers of the type described earlier herein are generally spherical in shape and employ a fill mark to indicate when the desired amount of additive has been poured into the dispenser. While the fill mark approach in a spherical dispenser has worked well for products which are relatively dilute (when compared to the more highly concentrated products being marketed today) when the volume of product to be added is quite small accurate measurement thereof is quite difficult to achieve with prior art style dispensers because even a slight deviation from the fill mark represents a substantial change in product volume, i.e., the cross-section of the sphere increases rapidly in the area of the fill mark so that slight deviations from the fill mark represent substantial deviations in the amount of product actually included within the dispenser, particularly if the user overshoots the fill mark.

In addition, it has been observed that prior art dispensers of the type described earlier herein may tend to lose some of the additive initially placed in the dispenser during the wash cycle due to flexing of the valve member during the wash cycle, even though the valve may remain in a substantially closed condition until the dispenser is subjected to a spin cycle. This loss of product also negatively impacts the benefits provided by highly concentrated rinse additives, since their loss during the wash cycle renders them unavailable to impart benefits to the laundered fabrics during the rinse cycle. Loss of the highly concentrated additive is particularly detrimental, since it results in a greater loss of the active materials when compared to less concentrated fluid product forms.

OBJECTS OF THE INVENTION

Accordingly, it is an object of the present invention to provide an improved method and apparatus which makes accurate measurement of the laundry additive into the dispenser relatively easy for the user.

It is another object of the present invention to provide a dispensing apparatus having an improved valve seal which substantially prevents the loss of any laundry additive from the dispenser during the wash cycle.

It is still another object of the present invention to provide such an improved rinse additive dispenser which will maintain the center of gravity of the dispenser and the additive contained therein in a position that will ensure the ability of the rinse water to enter and exit the dispenser through the filling/dispensing aperture of the dispenser once the valve used to close the filling/dispensing aperture has moved to its open position to effectively utilize all of the rinse additive originally placed within the dispenser.

DISCLOSURE OF THE INVENTION

Briefly, the present invention, in a particularly preferred embodiment provides an improved method of accurately measuring a relatively small amount of fluid additive within the confines of an improved dispenser. The improved method involves adding the liquid additive to a dispenser which is provided with a base having an internal upwardly extending pushup configuration. In a particularly preferred embodiment the pushup configuration extends proximately to the desired fill level of laundry additive in the dispenser. It can, if desired, also extend above the desired fill level. Thus, the laundry additive forms an annular column within the dispenser so that even though a relatively small amount of fluid is involved, the rise of the fluid in the annular column can be readily observed and accurately controlled. This also alleviates the severity of minor errors caused by slightly missing the predetermined fill line or fill point in the dispenser, since the amount of fluid per unit of vertical height within the dispenser is determined only by the volume of the annular column, and not the entire cross-section of the dispenser.

The internal pushup configuration within the dispenser also serves to prevent the counterweight and valve used to close the filling/dispensing aperture from interfering with the fluid measurement process, since the annular column formed by the pushup configuration is preferably sized so as to prevent any portion of the counterweight or valve member from entering into the annular column and displacing any of the fluid being measured during the dispenser filling process.

Finally, the pushup configuration of the base within the dispenser of the present invention can be used to adjust the center of gravity of the dispenser to ensure that the filling/dispensing aperture in the dispenser will be properly oriented when the dispenser is lying in the washer drum as the rinse water is entering. A substantially horizontal orientation of the dispenser's vertical axis allows the rinse water to readily enter and flood the dispenser through the filling/dispensing aperture once the valve is opened. This is preferably accomplished by vertically positioning the uppermost portion of the pushup configuration within the dispenser so that it prevents the counterweight used to open the valve from getting too near the base of the dispenser. In addition, the internal pushup configuration can be thickened, as desired, to provide sufficient ballast at the bottom end of the dispenser so that the vertical axis of the dispenser will normally be oriented in a substantially horizontal position within the rinse water. This further helps to ensure that rinse water may readily enter and exit through the filling/dispensing aperture throughout the rinse cycle when the valve is open. Because it is not necessary to see through the internal base pushup configuration during the filling cycle, the thickened plastic which may be employed as ballast in this portion of the dispenser does not interfere with the user's ability to view the level of liquid additive as it is poured into the dispenser. Thus, in a particularly preferred embodiment of the present invention which employs a translucent, preferably transparent, dispenser body, accurate measurement of small fluid volumes, e.g., on the order of one fluid ounce, is readily feasible. This measurement is made even easier if the laundry additive in question is colored or tinted so that it contrasts with the dispenser body.

In yet another aspect of the present invention, an improved sealing valve is provided in the dispenser to substantially prevent the loss of any rinse additive material during the wash cycle. Unlike prior art dispensers of the type described earlier herein which attempt to form a face seal about the filling and dispensing aperture in the dispenser body, the improved seal valve of the present invention repositions the liquid seal to an internal cylindrical or tubular member which projects from the innermost surface of the dispenser body about the filling/dispensing aperture. The improved seal valve employs a mating flange having a resiliently deformable outermost periphery which forms a piston-type seal with the innermost surface of the cylindrical member. Because the flange can move about its axis and back and forth within the cylindrical member without losing its sealing engagement with the cylindrical member, vibrations imparted to the sealing valve by movement of the counterweight prior to actual opening of the valve do not permit loss of the fluid additive from the dispenser during the wash cycle. Thus, substantially all of the fluid additive material initially placed in the dispenser is available for dispensing into the rinse water once centrifugal forces applied during the spin cycle have caused the valve detent to disengage from the filling/dispensing aperture in the body of the dispenser.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

The Body

Figure 1:
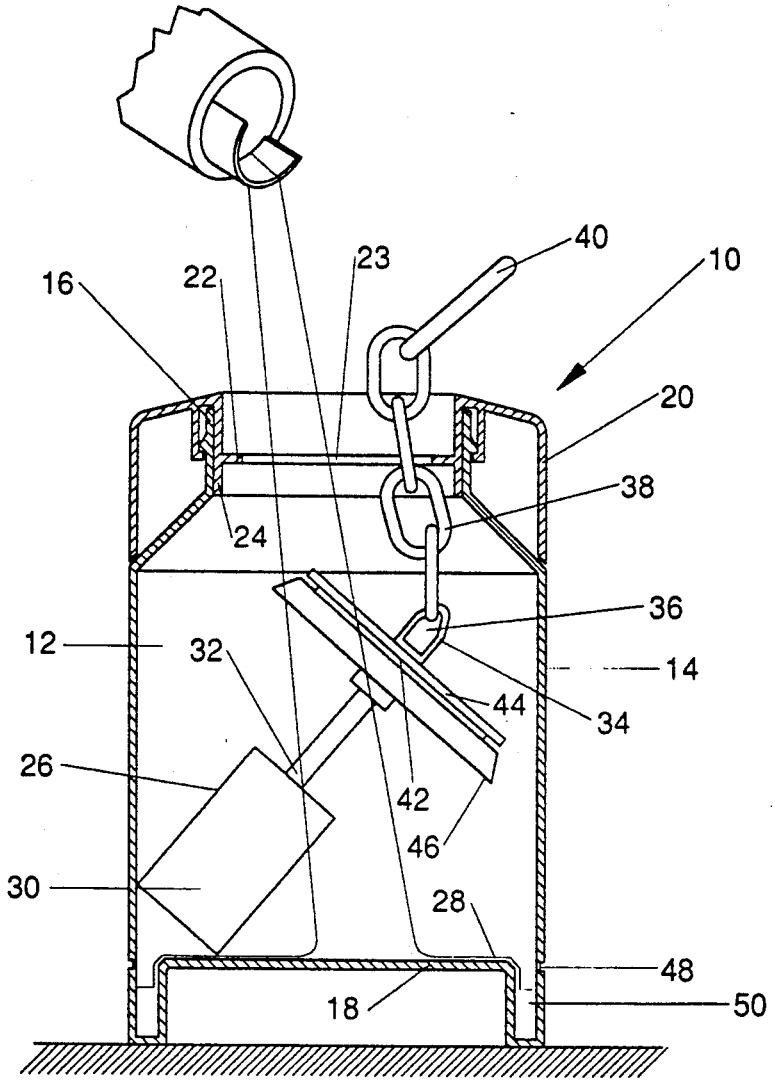
FIG. 1 is a sectioned front elevation view of a dosing dispenser, taken through the center of the dispenser, showing the dispenser setting upright with valve open and fluid being poured into the annular volume around the pushup configuration.

Referring now to the Drawings, and more particularly to FIG. 1, there is shown a preferred embodiment of the present invention, generally indicated as 10. A fluid dispenser chamber 12 is constructed with continuous side walls 14, with open finish 16 and closed bottom end 18. Snapped onto finish 16 is valve housing 20. Valve housing 20 has an annular flange or face 22 surrounding filling/dispensing opening 23. Opening 23 is the only fluid communication opening between chamber 12 and the outside of the dispenser. Annular flange or face 22 serves as a detent which holds the valve member in its closed position. Valve housing 20 also has an internally extending cylindrical wall 24, the internal surface of which forms a seal with the resiliently deformable periphery of a flange 46 on the valve member 42.

The Weight and Pull Ring

In FIG. 1 a valve and weight assembly 26 is shown unseated within chamber 12, resting against inside surface 28 of pushed up bottom end 18. Assembly 26 has a preferably rigid weight 30 and rigid stem 32. At the end of stem 32, opposite weight 30, is a tapered portion 34 with hole 36 therethrough. Connected to tapered portion 34 through hole 36 is a chain 38. Connected to the other end of chain 38 is pull ring 40. Pull ring 40 is used to manually seat assembly 26 after chamber 12 is filled to the desired level with product fluid.

Because the chain and pull ring are flexibly connected to one another, they cannot impart opening forces against the valve member during the wash cycle. They can exert forces only in tension. Furthermore, because the valve member, including tapered portion 34, are recessed completely within valve housing 20, they are substantially protected against premature opening during the wash cycle due to contact with articles of clothing being laundered or portions of the washing machine.

Protection against premature opening is extremely important for rinse additive dispensers, since premature opening of the dispenser during the wash cycle will most likely result in complete loss of the additive during the wash cycle.

The Valve Means

Between tapered portion 34 and weight 30 is resilient disk valve 42 connected to stem 32 by means of a groove formed in conjunction with stem 32 which engages a hole in disk 42, preferably by means of an interference fit. Disk valve 42 has an upper flanged portion 44 which seats against annular face 22 and a lower flanged portion 46 which seats the innermost surface of annular face 22 when the valve is manually pulled closed. Flanged portions 44 and 46 serve as a detent with annular flange 22 to hold the valve in a closed position until the spin cycle of the washing machine takes place. The portion of valve 42 between flange 44 and flange 46 closes, but does not completely fill opening 23. It also serves to pull flange 44 against face 22 of housing 20 after the resiliently deformable periphery of flange 46 has formed a movable piston-type seal against the innermost surface of cylindrical or tubular wall 24. The movable piston-type seal thus formed prevents fluid from exiting chamber 12 despite movement of the flange 46 within cylindrical member 24 until such time as the detent formed between flanges 44 and 46 and annular flange 22 becomes disengaged from filling/dispensing aperture 23.

The Filling Problem

When assembly 26 is in the open position, as shown in FIG. 1, and the dispenser 10 is setting upright, either on a horizontal surface or held in one's hand, a product fluid may be poured into dispenser 10 through opening 23. This fluid is preferably highly concentrated in the present invention; therefore, its volume is quite small. However, since it is concentrated, its accuracy of filling to a desired volume is more important than if it were dilute. Dispenser 10 is of a size that is small enough to fit within the washer drum of most clothes washers without being battered by frequent contact with the washer agitator during the wash cycle or interfere with the operation of the washing machine, yet it is preferably large enough that it does not easily become entrapped in clothing, e.g., pockets, pantlegs, etc. Thus, it is preferable that dispenser 10 not be substantially reduced in size relative to prior art dispensers even though a much smaller volume of fluid is normally used in it. This helps to provide the buoyancy needed to keep it near the surface of the water during the wash cycle.

The Filling Solution

With a conventional flat bottom in chamber 12, the desired volume accuracy cannot easily be controlled via pouring to a visual fill-line or mark when a relatively small amount of fluid, e.g., about one fluid ounce, is to be measured. However, with bottom end 18 pushed up to a point where its inner surface 28 is at or above a fill-line 48 to produce a narrow annular column 50 between wall 14 and the pushup configuration wall, the ratio of fill height to volume is substantially increased. It is believed that this higher ratio permits more accurate visual alignment of a fluid level, with fill-line 48, and therefore more accurate filling. While the pushup configuration can go higher than the desired fill line, it is believed that visual acuity will be maximized if the top of the pushup configuration and the fill line approximately coincide with one another.

Other Pushup Advantages

Another advantage of having pushed up bottom end 18 with its inner surface 28 at or above fill-line 48 is that the annular column 50 thus formed substantially prevents the weight and valve assembly 26 from resting in the additive fluid during the measurement process. Importantly, this avoids displacing fluid which could cause an erroneous volume measurement. It is also believed that the proximity of flat surface 28 at or near the level of fill-line 48 helps the user judge whether or not the dispenser is being held level while filling it. This is also important to accurate measurement.

Need for Buoyancy

After filling and closing the valve 42, dispenser 10 is gently placed in the washer prior to starting the wash cycle. When the wash water rises, dispenser 10 floats in the wash water. Buoyancy helps prevent dispenser 10 from becoming entrapped in clothing or being battered by the extended agitator fins of the washer below the water level. Although dispenser 10 employs a flexible chain and pull ring and a completely recessed valve member to minimize the chance of premature opening in the wash cycle, excessive clothing or agitator contact is nonetheless undesirable, since severe collisions tend to cause the dispenser to open prematurely. If this happens, the product fluid is lost with the wash water and is not available for the rinse cycle as desired.

Spin Cycle Orientation

Figure 2:
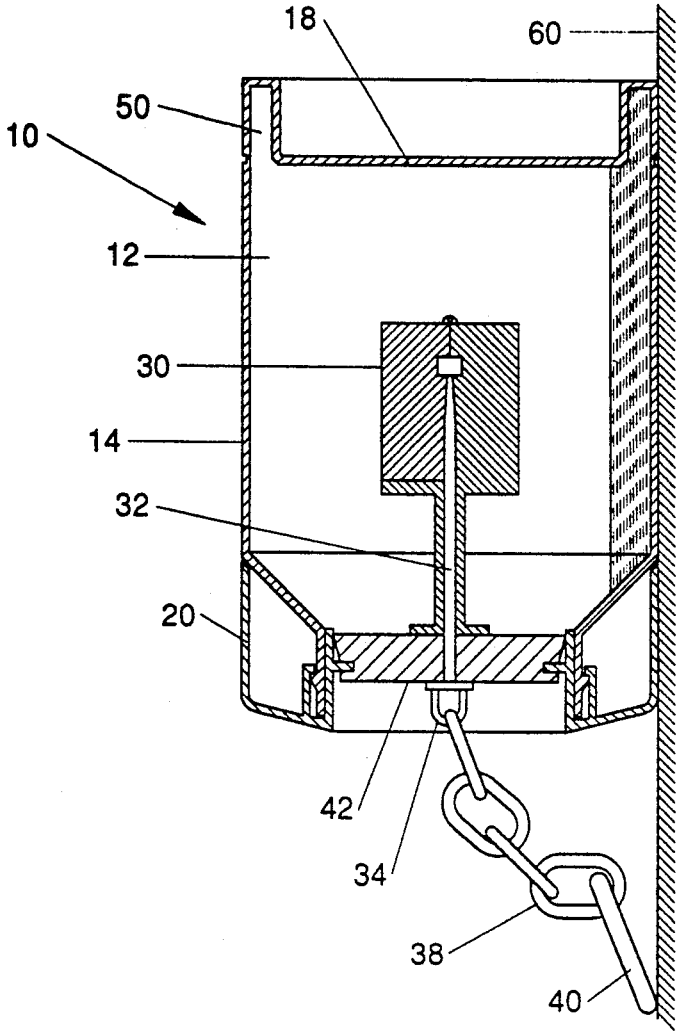
FIG. 2 is a sectioned front elevation view of a dosing dispenser, taken through the center of the dispenser and through a vertical section of the washing machine drum, showing the dispenser held against the spinning washer drum just before centrifugal force pulls the cantilevered weight toward the drum to open the valve.

Dispenser 10 is preferably shaped like a barrel and has a length greater than its circular cross-section so that its most stable orientation is at rest on a side 14 rather than on an end. FIG. 2 shows how the dispenser 10 may position itself by resting against the innermost surface of the washer's drum 60 during a spin cycle. A side 14 contacts the drum 60 during the spinning cycle which follows the washing cycle. In this orientation the centrifugal force of the spinning drum acting on cantilevered weight 30 generates a bending moment at valve 42. The bending moment required to open the valve 42 is relatively predictable as a function of drum RPM. If valve housing 20 were resting against the drum during the spin cycle, the centrifugal force would act to hold the valve 42 closed, i.e., it would tend to cause flange 46 to be pushed outward. If bottom end 18 rested against the drum 60, the centrifugal force would act to pull the weight 30 toward the bottom end 18. This would tend to open the valve 42, but would typically require a higher centrifugal force since there is no bending moment of the type presented by a cantilevered beam, as shown in FIG. 2.

Rinse Cycle Orientation

Figure 3:
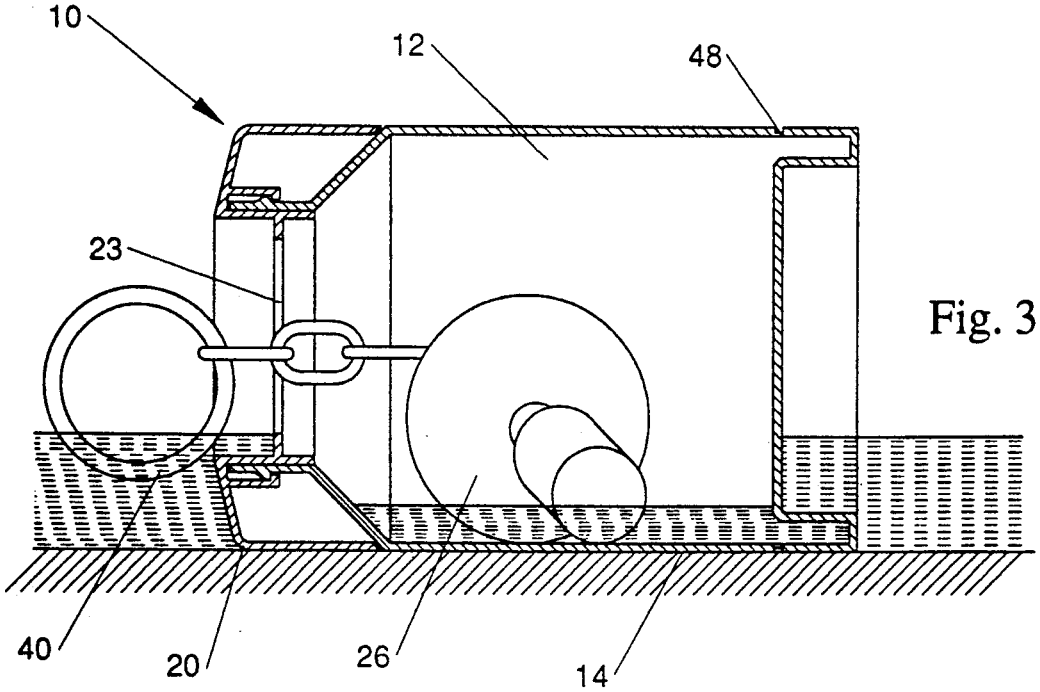
FIG. 3 is a sectioned front elevation view of a dosing dispenser, taken through the center of the dispenser, showing the dispenser as it would normally lie on the bottom of the drum after the spin cycle with its valve open, just before rinse water enters the dispenser to flood the dispenser and begin flushing out the product fluid.

FIG. 3 shows the dispenser 10 after the washer spin cycle has been completed, the centrifugal force of the spin cycle has opened the valve and the rinse water has begun to enter the drum. When rinse water fills the washer drum, it is desirable for the dispenser 10 become substantially flooded. This flooding process is just about to commence in FIG. 3.

If opening 23 were maintained above the water level throughout the rinse cycle so that the dispenser could not become partially flooded, water could not easily enter and exit the dispenser. As a result all of the product fluid may not be flushed out.

Conversely, if the filling/discharge aperture 23 remains completely inverted throughout the rinse cycle, an air pocket would remain within the dispenser and cause it to float. This too could make complete flushing of the interior of the dispenser with rinse water difficult.

For maximum effectiveness, it is believed most desirable for dispenser 10 to remain close to a substantially horizontal condition so it can fill as much as possible with rinse water and so that turbulence of the rinse cycle agitation can pull it under to help to flush the product fluid out of the dispenser 10.

Pushup used to trim Center of Gravity

The valve and weight assembly 26 fall to one side of chamber 12 when pulled out of opening 23 by centrifugal force in the spin cycle. This effectively moves the center of gravity of the dispenser 10 to near its center. Being longer than it is across, the barrel shaped dispenser 10 then has stability for assuming a natural horizontal orientation and for floating substantially on its side 14 during the rinse cycle. To further encourage such orientation or floating, the pushed up bottom end 18 can serve two additional functions. First it can limit the travel of the assembly 26 to maintain the center of gravity of assembly 26 near the center of dispenser 10. Second, it can provide a region to add ballast material in order to trim the center of gravity of the dispenser to an optimum position to ensure complete emptying of the dispenser's contents during the rinse cycle. Because the wall 14 of the dispenser is normally translucent, and preferably transparent, for easily sighting the fill level of the fluid additive with fill-line 48, varying the thickness of external wall 14 is less desirable because greater thickness typically reduces visibility. However, increasing the thickness of the bottom pushup configuration 18 to provide ballast does not adversely affect the user's ability to visually see the product level during filling. Furthermore, increasing the thickness of the bottom end 18 is less expensive than adding separate weights to the dispenser.

Completion of the Dispensing Cycle

After rinse water has flushed product fluid from the dispenser, and the final machine cycle is completed, the dispenser may be removed from the washer drum and drained of water so that it may be refilled, as in FIG. 1, for the next wash load.

Pull Ring connected by Chain

FIG. 2 shows the use of a chain 38 to connect the pull ring 40 with the valve and weight assembly 26. An alternative to the chain is a cable or other flexible linkage. These connectors transmit force only when in tension. Therefore, they are not prone to cause premature opening during the wash cycle. Protection against premature opening is maximized when flexible chain 38 and pull ring 40 are used in conjunction with recessing of the tapered end 34 of the rigid stem 32 inward of the outermost surface of housing 20. This protects tapered end 34 of stem 32 from inadvertent bumping during the wash cycle. If desired, the pull ring 40 may be snapped into a detent (not shown) in the valve housing 20 to further protect valve 42 from being prematurely dislodged from opening 23 during the wash cycle.

Exemplary Embodiment

In an exemplary embodiment of the present invention, the dispenser elements can be designed and made as follows:

Dispenser chamber walls 14 can be approximately 0.03 inches thick and can be made of a material such as clarified polypropylene. They can be shaped generally like a whiskey barrel with a maximum diameter of approximately 3 inches and a maximum height, including valve housing 20, of approximately 3 ½ inches. Dispenser chamber bottom 18 can be approximately 0.15 inches thick and can be pushed up approximately ⅝ inches with a sloping outer diameter ranging from approximately 1.98 inches, as measured at the top of the pushup configuration, to approximately 2.2 inches, as measured at the bottom of the dispenser, thereby creating an annular column 50 below fill-line 48 of approximately 1.8 cubic inches, which corresponds to a volume of approximately one fluid ounce of liquid. Dispenser chamber 12 can be made by a stretch blow mold process of the type well known in the art.

Valve housing 20 preferably has an annular flange 22 measuring approximately 1 ⅝ inches in diameter and including a filling/dispensing opening 23 which measures approximately 1.1 inches in diameter centered on the axis of the barrel-shaped dispenser. Housing 20 also has an internal cylindrical or tubular wall 24 which measures approximately 0.2 inches in length and has an internal diameter of approximately 1.64 inches. Housing 20 can be made of a material such as polypropylene plastic by an injection molding process of the type well known in the art.

Weight 30 and stem 32 may be comprised of a material such as metal, e.g., aluminum, or a substantially rigid plastic, e.g., molded polypropylene. The weight 30, which is preferably molded in an open condition and thereafter closed about the stem, as generally shown in the cross-section of FIG. 2, weighs approximately 0.56 ounces and is positioned so that its center is located approximately 1 ¼ inches from the center of valve 42, such that the centrifugal acceleration typically experienced in a washing machine spin cycle will dislodge valve 42 from aperture 23 in valve housing 20 during the spin cycle which follows the washing cycle.

Valve 42 can be made of Shore A 58 durometer polyisoprene elastomer by an injection molding process of the type well known in the art. Alternatively, natural rubber can be compression molded to form valve 42. Valve 42 is preferably assembled onto stem 32 by forcing the hole in its center over that portion of the stem to which the weight 30 is secured prior to assembly of the weight 30 onto the stem. Flange 44 on valve 42 can be about 0.035 inches thick and about 1 ¼ inches in diameter. Flange 46, which also acts as a piston within cylindrical or tubular member 24, can be about 0.07 inches thick. Flange 46 preferably has a minimum outside diameter of about 1 19/32 inches, as measured at its uppermost edge, tapering to a maximum outside diameter of about 1 11/16 inches, as measured at its lowermost edge. In lieu of a taper, a step-like cross-section could be employed to provide the desired degree of resilient deformability at the outermost periphery of flange 46. The tapered portion of flange 46 is resiliently deformable to form a movable piston-type seal with the innermost surface of cylindrical or tubular member 24.

The ring 40, chain 38 and stem 32, including connecting member 34 are preferably molded as one unit using an acetal resin such as Delrin via an injection molding process of the type well known in the art. The pull ring 40 can have an outside diameter of approximately 1.25 inches, an inside diameter of approximately 0.92 inches and is preferably connected to element 34 on stem 32 by means of three oval links. The first oval link that connects to the pull ring 40 has a major axis of approximately 0.4 inches and a minor axis of approximately 0.23 inches, while the remaining two links have a major axis of approximately 0.34 inches and a minor axis of approximately 0.16 inches.

Dispenser 10 has an overall internal volume of approximately 15.9 cubic inches and a fully assembled weight of approximately 2.33 ounces, not counting the fluid product to be housed within the dispenser. The normal dose of fluid product to be included within the dispenser which is targeted to coincide with fill line 48 is approximately one fluid ounce or approximately 1.8 cubic inches within annular column 50.

While the dispenser 10 is particularly well suited for dispensing relatively small amounts of highly concentrated rinse water additive, it is of course recognized that the dispenser may also be employed to dispense greater volumes of less concentrated rinse water additives. In such applications additional fill level markings can be provided, as appropriate, for less concentrated products.

While particular embodiments of the present invention have been illustrated and described, it will be obvious to those skilled in the art that various changes and modifications can be made without departing from the spirit and scope of the invention, and it is intended to cover in the appended claims all such modifications that are within the scope of this invention.

What is claimed is:

1. An improved dispenser that permits accurately measuring and reliably adding a predetermined quantity of fluid rinse additive to the rinse water in an automatic washing machine, said dispensing comprising:

(a) a container having an internal volume significantly greater than the volume of fluid additive to be dispensed to provide buoyancy and to prevent the dispenser becoming entangled within articles being laundered, said container including an internal pushup configuration originating in its base and extending vertically within said container at least to a position which approximately corresponds to the level of said predetermined quantity of fluid additive, thereby forming an annular cavity within said container for housing said predetermined quantity of fluid additive;

(b) a filling/dispensing aperture disposed within the uppermost portion of said container for adding said fluid additive to said dispenser and for allowing rinse water to enter and exit said dispenser, said container further including a tubular member surrounding the internal surface of said filling/dispensing aperture; and (c) a manually closable, centrifugally openable valve means for closing said filling/dispensing aperture in said container after said dispenser has been filled and for maintaining substantially all of said fluid additive within said dispenser throughout the wash cycle until said dispenser is subjected to a predetermined centrifugal force during the spin empty portion of the wash cycle, said predetermined centrifugal force being sufficient to cause said valve means to pen, said valve means including a generally conforming tapered flange below said aperture, said tapered flange having an uppermost edge and a lowermost edge, said lowermost edge having a greater circumference than said uppermost edge, said tapered flange having a resiliently deformable periphery which forms a moveable piston-type seal against the internal surface of said tubular member when said valve means is in its closed position, said seal being maintained even where there is movement between said piston periphery and said internal surface of said tubular member provided said valve means remains in its closed position, whereby said additive will be retained in said dispenser until it is flushed out by rinse water during the rinse portion of the laundry cycle.

2. The dispenser of claim 1, wherein said valve means includes a counter weight which responds to said centrifugal force during said spin cycle and wherein said annular cavity formed between said base pushup configuration and said container is sufficiently small that said counter weight and said valve means are prevented from entering said annular cavity and displacing any of the fluid rinses additive to be housed in said annular cavity when said valve means is open and said fluid is being added.

3. The dispenser of claim 1, wherein said container is comprised of translucent material.

4. The dispenser of claim 1, wherein said container is comprised of transparent material.

5. The dispenser of claim 1, wherein said container exhibits a generally circular cross-section, as measured perpendicular to its vertical axis.

6. The dispenser of claim 5, wherein said internal push up configuration in said base maintains the center of gravity of said dispenser in such a position that the vertical axis of said dispenser will remain substantially horizontal when said dispenser is floating in said rinse water after said valve means has been opened by centrifugal force.

7. The dispenser of claim 6, wherein said internal pushup configuration in said base exhibits a thicker wall than the remaining portions of said container so as to provide ballast which helps to maintain the vertical axis of said container in a substantially horizontal condition when said dispenser is floating in said rinse water after the valve means has been opened by centrifugal force.

8. The dispenser of claim 1, wherein said valve means further includes a resilient detent which engages and closes said filling/dispensing aperture in said container when said valve means is in its closed position, yet which will release said valve means to its open position when a counter weight attached to said valve means is acted upon by the centrifugal forces imposed on the dispenser during said spin cycle.

9. The dispenser of claim 1, wherein said manually closable, centrifugally openable valve means is completely recessed from the outermost surface of said dispenser to minimize the chance of premature opening during the wash cycle.

10. The dispenser of claim 9, wherein said manually closable, centrifugally openable valve means includes a flexible tension member which projects beyond the outermost surface of said dispenser for closing said valve, but which tension member cannot exert inwardly directed opening forces against said valve means during the wash cycle.

11. The dispenser of claim 10, wherein said flexible tension member comprises a chain.

12. In a fluid rinse additive dispenser for an automatic washing machine, said dispenser having valve means for maintaining said rinse additive within said dispenser until said valve means is acted upon by centrifugal forces imposed on said dispenser during the spin cycle which follows the washing cycle, the improvement wherein said valve means comprises a filling/dispensing aperture within said dispenser which is closed, after filling, by a resilient disk having a detent, said valve means further including an internal tubular member adjacent the innermost surface of said filling/dispensing aperture, said disk having tapered a flange below said detent, said flange having an uppermost edge and a lowermost edge, said lowermost edge having a greater diameter than said uppermost edge, said tapered flange having a resiliently deformable periphery sized to form a movable piston-type fluid tight seal against the innermost surface of said tubular member, whereby limited movement of said flange relative to said tubular member does not defeat said fluid tight seal, so long as said resilient detent on said valve means remains engaged with said filling/dispensing aperture.

13. The dispenser of claim 12, wherein the periphery of said flange includes a resiliently deformable wiper ring which maintains piston-type sealing contact with the interior surface of said tubular member as long as said resilient detent on said valve means remains engaged with said filling/dispensing aperture.

* * * * *

UNITED STATES PATENT AND TRADEMARK OFFICE

CERTIFICATE OF CORRECTION

PATENT NO. : 5,267,671

DATED : December 7, 1993

INVENTOR(S) : Baginski et al

It is certified that error appears in the above-indentified patent and that said Letters Patent is hereby corrected as shown below:

On the title page: Item [56]

*In the "References Cited" "4,033,643" should be -- 5,033,643 --.*

*Column 3, line 11, delete "proximately" and insert therefor -- approximately --.*

*Column 10, line 27, Claim 1, delete "pen" and insert therefor -- open --.*

Signed and Sealed this

Fourth Day of April, 1995

Bruce Lehman

*Attest:*

BRUCE LEHMAN

*Attesting Officer*

*Commissioner of Patents and Trademarks*